US008731384B2

(12) United States Patent
Cho et al.

(10) Patent No.: US 8,731,384 B2
(45) Date of Patent: May 20, 2014

(54) STEAM HEAD FOR CLEANER

(75) Inventors: Seong-Koo Cho, Changwon-si (KR); Geun-Bae Hwang, Changwon-si (KR); Jin-Hyouk Shin, Changwon-si (KR); Dong-Jae Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 604 days.

(21) Appl. No.: 13/055,035

(22) PCT Filed: Dec. 26, 2008

(86) PCT No.: PCT/KR2008/007699

§ 371 (c)(1),
(2), (4) Date: Feb. 18, 2011

(87) PCT Pub. No.: WO2010/011003

PCT Pub. Date: Jan. 28, 2010

(65) Prior Publication Data

US 2011/0150438 A1 Jun. 23, 2011

(30) Foreign Application Priority Data

Jul. 21, 2008 (KR) ..... 10-2008-0070566
Jul. 21, 2008 (KR) ..... 10-2008-0070570
Jul. 21, 2008 (KR) ..... 10-2008-0070572
Jul. 22, 2008 (KR) ..... 10-2008-0071032

(51) Int. Cl.
*F22B 29/06* (2006.01)
*F22B 35/06* (2006.01)

(52) U.S. Cl.
USPC ..... 392/396; 392/400; 392/434

(58) Field of Classification Search
None
See application file for complete search history.

(56) References Cited

U.S. PATENT DOCUMENTS

| | | | | | |
|---|---|---|---|---|---|
| 4,334,141 | A | * | 6/1982 | Roller et al. | 392/467 |
| 4,343,988 | A | * | 8/1982 | Roller et al. | 392/467 |
| 4,354,878 | A | * | 10/1982 | Hutchison et al. | 106/796 |
| 4,371,777 | A | * | 2/1983 | Roller et al. | 392/480 |
| 4,419,302 | A | * | 12/1983 | Nishino et al. | 261/142 |
| 4,696,074 | A | * | 9/1987 | Cavalli | 15/321 |
| 5,539,857 | A | * | 7/1996 | McGrevy | 392/484 |
| 5,920,952 | A | * | 7/1999 | Baldacci | 15/320 |
| 6,075,230 | A | * | 6/2000 | Wilson | 219/544 |
| 6,148,144 | A | * | 11/2000 | Milanese | 392/405 |
| 6,233,398 | B1 | * | 5/2001 | Rutherford et al. | 392/503 |
| 6,263,158 | B1 | * | 7/2001 | Rutherford | 392/503 |
| 6,289,551 | B1 | * | 9/2001 | Basile | 15/320 |

(Continued)

FOREIGN PATENT DOCUMENTS

| | | |
|---|---|---|
| CN | 1093514 | 10/1994 |
| CN | 101055071 | 10/2007 |

(Continued)

*Primary Examiner* — Thor Campbell
(74) *Attorney, Agent, or Firm* — McKenna Long & Aldridge LLP

(57) ABSTRACT

The present invention relates to a steam head of a cleaner. The present invention includes a steam head including: a body defining an exterior, and a steam generating device provided on the body to generate steam through heating water supplied through a heater, the heater including a radiator of a ceramic material, and a plurality of insulation layers for insulating the radiator, wherein the plurality of insulation layers is formed of one of or a combination of one or more of magnesium oxide (MgO), a slurry-phase insulator, and an insulation film. Thus, through the present invention, a heater's heat radiating performance is improved to facilitate generation of steam.

13 Claims, 4 Drawing Sheets

(56) References Cited

U.S. PATENT DOCUMENTS

| | | | | |
|---|---|---|---|---|
| 6,584,990 | B2 * | 7/2003 | Shaw | 134/105 |
| 6,647,204 | B1 | 11/2003 | Hutchinson | |
| 6,816,670 | B1 * | 11/2004 | Renau | 392/467 |
| 6,895,626 | B2 * | 5/2005 | Tsai | 15/50.1 |
| 7,266,292 | B1 * | 9/2007 | Tsai | 392/465 |
| 7,813,628 | B2 * | 10/2010 | Haan | 392/441 |
| 7,891,047 | B2 * | 2/2011 | Milanese | 15/320 |
| 7,917,991 | B2 * | 4/2011 | Chung et al. | 15/321 |
| 8,353,074 | B2 * | 1/2013 | Krebs | 15/98 |
| 2006/0108433 | A1 * | 5/2006 | Fossati et al. | 236/44 C |
| 2009/0223076 | A1 * | 9/2009 | Kim | 34/72 |
| 2010/0186463 | A1 * | 7/2010 | Vrdoljak et al. | 68/222 |

FOREIGN PATENT DOCUMENTS

| | | | |
|---|---|---|---|
| CN | 201066936 | | 5/2008 |
| FR | 2909275 | | 6/2008 |
| GB | 2410422 | | 8/2005 |
| JP | 06-052975 | | 2/1994 |
| JP | 2007-059061 | | 3/2007 |
| KR | 10-1994-0019182 | A | 8/1994 |
| KR | 10-1997-0047603 | A | 7/1997 |
| KR | 10-1997-0033291 | | 8/1999 |
| KR | 20-0214981 | | 12/2000 |
| KR | 10-2002-0027141 | | 4/2002 |
| KR | 10-0401327 | | 10/2003 |
| KR | 10-2004-0082518 | A | 9/2004 |
| KR | 10-2004-0101305 | | 12/2004 |
| KR | 10-2005-0003730 | A | 1/2005 |
| KR | 10-2006-0028620 | A | 3/2006 |
| KR | 20-0418234 | | 6/2006 |
| KR | 10-2006-0104731 | | 10/2006 |
| KR | 10-2007-0049706 | | 5/2007 |
| KR | 10-0718593 | | 5/2007 |
| KR | 10-0726685 | | 6/2007 |

* cited by examiner

STEAM HEAD FOR CLEANER

This application is a 35 U.S.C. §371 National Stage entry of International Application No. PCT/KR2008/007699, filed on Dec. 26, 2008, which claims the benefit of the earlier filing date and right of priority to Korean Application Nos. 10-2008-0070572, filed Jul. 21, 2008; 10-2008-0070570, filed Jul. 21, 2008; 10-2008-0070566, filed Jul. 21, 2008 and 10-2008-0071032, filed Jul. 22, 2008, the contents of which are hereby incorporated by reference herein in their entirety.

TECHNICAL FIELD

The present invention relates to a steam head for a cleaner.

BACKGROUND ART

In general, a steam head for a cleaner removes impurities by discharging steam generated through heating water onto a surface to be cleaned, and for this purpose, a steam generating device is provided on the nozzle of the cleaner to generate steam. Also, a heater is provided within the steam generating device to convert water to steam by using high heat.

When the heater used is a widely used sheath heater, because the portion that comes into contact with water is not ground, its surface is generally insulated with a Teflon coating or a ceramic coating in order to prevent the occurrence of accidents such as electrocution during cleaning with the steam cleaner.

However, the above related art has the following problems.

Because there is the possibility of portions of a heater (included in steam heads of cleaners according to the related art) coated with Teflon coating or ceramic coating being removed through shock or friction during use, in such cases, there is the possibility of a user being electrocuted.

Due to the above problems, there is a need for double insulation of a heater installed and used in a steam cleaner in order to improve safety.

However, when double insulation is provided to improve safety of the above heaters, the insulation layers reduce the amount of heat generated by the heater, thus creating the problem of reduced exothermicity of the heater.

DISCLOSURE OF INVENTION

Technical Problem

The present invention provides a steam head of a cleaner that improves the insulating structure of a heater to reduce internal heat resistance for improved heat radiating performance.

Technical Solution

The present invention includes a steam head including a body defining an exterior, and a steam generating device provided on the body to generate steam through heating water supplied through a heater, the heater including a radiator of a ceramic material, and a plurality of insulation layers for insulating the radiator, wherein the plurality of insulation layers is formed of one of or a combination of one or more of magnesium oxide (MgO), a slurry-phase insulator, and an insulation film.

Advantageous Effects

A steam head for a cleaner according to the present invention has a heater for generating steam formed of a ceramic heat radiator, an insulation layer employing an insulating film on the heat radiator, and an insulation layer using a slurry-phase insulation material that is combined with an insulation layer using magnesium oxide (MgO), in order to have at least 2 or more insulation layers.

Also, because the insulation layer using the slurry-phase insulation material is formed through liquid injection molding (LIM) using magnesium hydroxide (Mg(OH)2) slurry, its thermal conductivity increases together with the insulation layer using the MgO when compared to the Teflon coating or ceramic coating material used as the insulation layer material in the related art.

Accordingly, because the heat generator is insulated through the above insulation layers having superior thermal insulation, the inner thermal resistance of the heat generator is reduced, so that heater's heat radiating performance is improved to make generation of steam easier.

MODE FOR THE INVENTION

Specific embodiments of the present invention will be described below with reference to the drawings. However, the spirit and scope of the present invention are not limited to the described embodiments, and those having skill in the art who understand the spirit of the present invention will easily be able to devise other embodiments that fall within the same spirit and scope.

Figure 1:
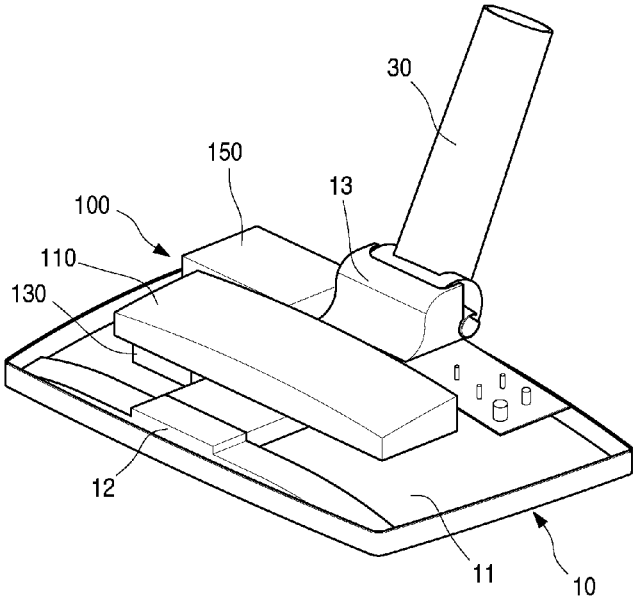
FIG. 1 is an inner perspective view of a steam cleaner provided with a heater according to an embodiment of the present invention.

FIG. 1 is an inner perspective view of a steam cleaner provided with a heater according to an embodiment of the present invention.

A steam head 1 of a cleaner employed in the present invention includes a head body 10 defining an exterior and having a seating portion 11 formed therein, a cover (not shown) provided above the head body 10 for covering the inside of the head body 10, and a connecting portion 30 provided at a side of the head body 10 to guide suctioned air to flow to a main body (not shown) of the cleaner.

The head body 10 is provided with an air inlet 12 for suctioning air including dust from a surface to be cleaned, and a suctioning passage 13 enabling air suctioned through the air inlet 12 to move to the connecting portion 30.

The suctioning passage 13 may extend rearward from the air inlet 12.

Also, the head body 10 is provided with a steam generating device 100 for converting supplied water to steam. The steam generating device 100 may be disposed above and to a side of the suctioning passage 13.

Below, the structure of the steam generating device 100 will be described with reference to the drawings, where the heater 200 (in FIG. 2) provided within the steam generating device 100 is heated through a heat conduction method where the heater 200 is immersed in water, or through an indirect heating method where a radiating member is connected to the heater 200 and immersed in water to generate steam.

Figure 2:
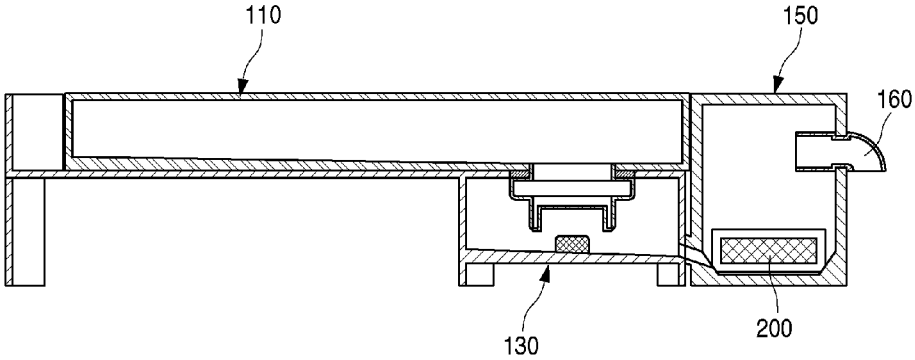
FIG. 2 is a sectional view taken along line I-I in FIG. 1, showing the structure of a steam generating device having a built-in heater according to an embodiment of the present invention.

FIG. 2 is a sectional view taken along line I-I' in FIG. 1, showing the structure of steam generating device having a built-in heater according to an embodiment of the present invention.

The steam generating device 100 includes a water tank 110 for storing supplied water, a reservoir 130 provided at a side of the water tank 110 and into which a predetermined quantity of water flows from the water tank 110, a heating portion 150 provided at a side of the reservoir 130 to heat water that flows from the reservoir 130, and a steam discharging portion 160 for discharging steam generated at the heating portion 150 to the outside.

The heating portion 150 is formed in an approximately hexahedral shape, and is provided with a heat conduction type heater 200 within that has a portion immersed in water flowing in from the reservoir to heat the water and generate steam. The heater 200 is formed of positive temperature coefficient (PTC) ceramic, and a more detailed description on the heater 200 will be provided below with reference to the diagrams.

Figure 3:
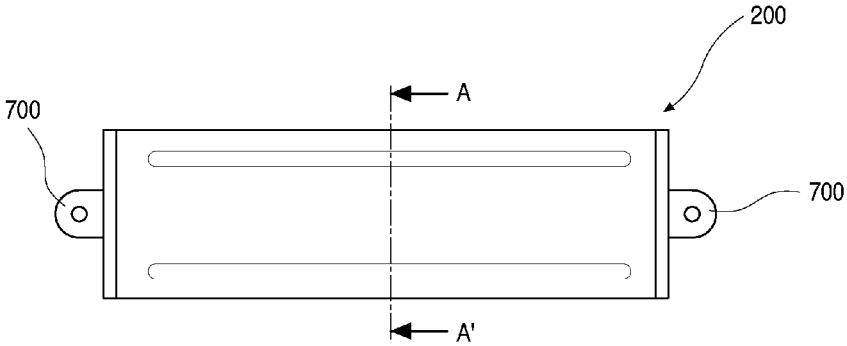
FIG. 3 is a diagram showing a heater according to an embodiment of the present invention.

FIG. 3 is a diagram showing a heater according to an embodiment of the present invention, and FIGS. 4 to 9 are sectional views showing an insulation structure of a heater according to various embodiments of the present invention.

Referring to the diagrams, a heater 200 according to an embodiment of the present invention receives power supplied through conductive plates 700, and generates heat using thermal radiation from a radiator 600 formed of ceramic material. Here, in embodiments of the present invention, a PTC ceramic device is used as the radiator 600.

The positive temperature coefficient (PTC) ceramic device used for the radiator 600, as a semiconductor device referred to as a static characteristic thermistor, has heat radiating capability for maintaining a predetermined temperature.

In detail, when temperature rises beyond a predetermined temperature, the PTC ceramic device gains greater resistance for decreasing current, and when temperature falls below a predetermined temperature, the resistance of the PTC ceramic device rises to increase current and raise temperature—which is repeatedly performed to give heat radiating performance with converged temperatures.

Thus, the above radiator 600 formed with a PTC ceramic device is made to not rise above a certain temperature so that safety is improved.

With the radiator 600 formed as above received within a case 400 formed of an aluminum material, a first insulation layer is formed using one of MgO 900, a slurry-phase insulator 800, and an insulation sheet 500, and a second insulation layer is formed on the outside of the first insulation layer, using one of MgO 900, a slurry-phase insulator 800, and an insulation sheet 500 that is not the material used to form the first insulation layer.

Here, the slurry-phase insulator 800, as a safe magnesium hydroxide (Mg(OH)2) slurry with good granularity, is formed by grinding magnesium oxide (MGO) 900 into particles to form a powder, mixing the formed powder with water and agitating the mixture, and then adding a dispersing agent.

Also, a plurality of embossings may be further formed on the case 400 to increase specific surface area and improve heat radiating capacity, and such embossings may be evenly arranged to better conduct heat generated from the radiator 600 to the outside and increase steam generating efficiency.

A more detailed description will be provided below on the formed configuration of the first insulation layer and the second insulation layer, with reference to the diagrams.

Figure 4:
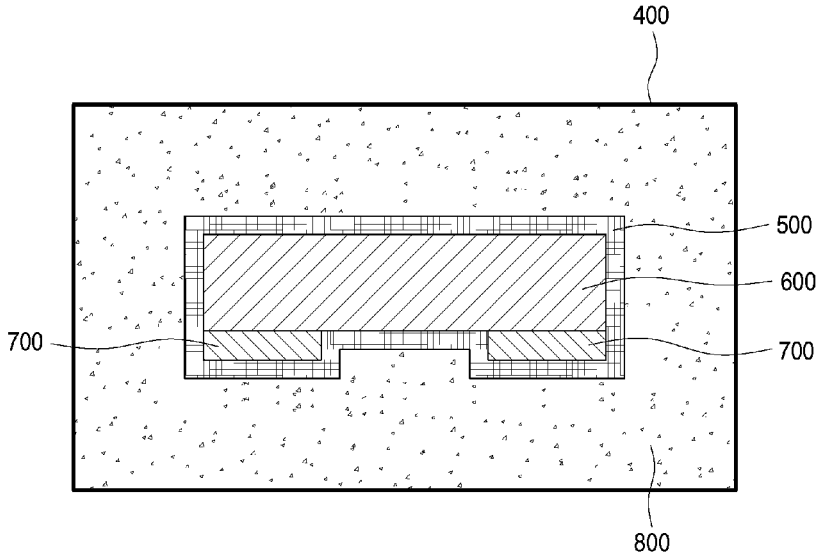
FIGS. 4 to 10 are sectional views showing an insulation structure of a heater according to various embodiments of the present invention.

In the embodiment shown in FIG. 4, the first insulation layer is formed as the insulation sheet 500, and the second insulation layer is formed as the slurry-phase insulator 800.

In further detail, in another embodiment of the present invention, in a connected state, a conductive plate 700 and a radiator 600 formed with PCT ceramic are received within an approximately rectangular-shaped case 400. Also, the insulation sheet 500 is wound on the radiator 600 received in the case 400 to form a first insulation layer.

Further, the slurry-phase insulator 800 is filled in a space between the first insulation layer and the inside of the case 400. Then, after a predetermined time elapses, the slurry-phase insulator 800 filled as above dries to form the second insulation layer.

Figure 5:
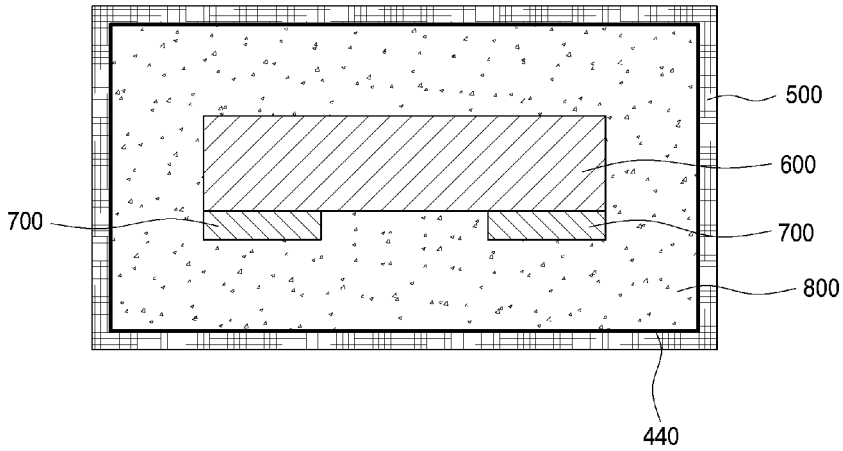

In FIG. 5, an insulation combination is shown that is formed with the first insulation layer formed as a slurry-phase insulator 800, and the second insulation layer formed as an insulation sheet 500.

If the heating method of the heater 200 in the above combination is indirect heating, a separate case 400 is not included.

That is, because the second insulation layer formed by the insulation sheet 500 does not directly contact water, the configuration does not include a separately formed case 400, and only a heat conducting member connected to the second conduction layer is made to contact water.

In further detail, in the embodiment of FIG. 5, a tube 440 of a corresponding size is provided at the outside of a heat source formed by the radiator 600 and the conductive plate 700, and after a slurry-phase insulator 800 is filled between the tube 440 and the radiator 600, it is dried to form the first insulation layer.

Also, an insulation sheet 500 is wound on the first insulation layer formed as described above to form a second insulation layer and an insulation combination.

Figure 6:
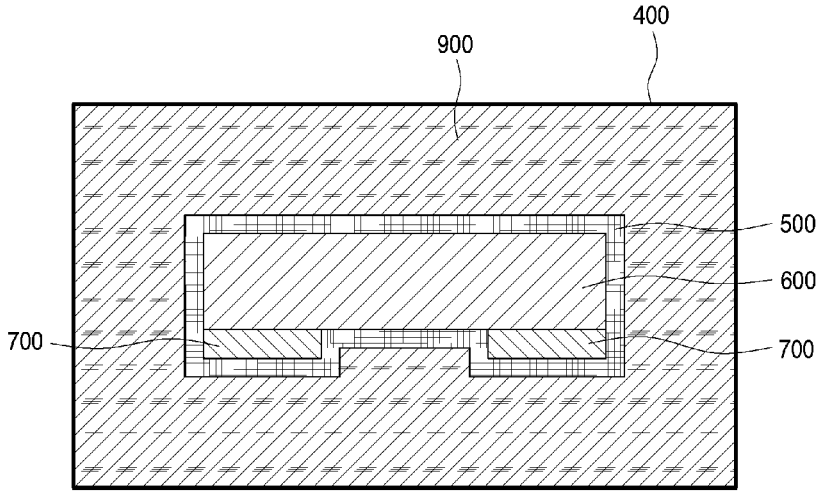

In FIG. 6, the first insulation layer is formed wound as an insulation sheet 500 on a radiator 600, and the radiator 600 with the first insulation layer wound thereon is received in a case 400.

Also, after an MgO 900 powder is charged between the first insulation layer and the case 400 in the above state, it is compressed to form the second insulation layer.

Figure 7:
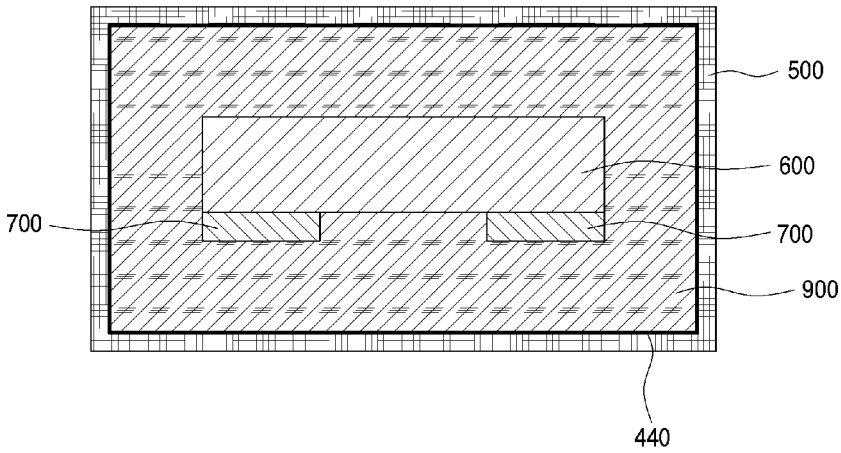

In FIG. 7, the first insulation layer and the second insulation layer are formed as a combination of MgO 900 and an insulation sheet 500.

Specifically, the heat source formed of the radiator 600 and the conductive plate 700 is received within the tube 440, and the MgO 900 powder is charged in the inner space between the above-received radiator 600 and the tube 440, after which pressure is imparted to form the first insulation layer.

Further, the second insulation layer is formed through winding an insulation sheet 500 around the outer periphery of the case 400, and like the embodiment shown in FIG. 5 described above, a separate case 400 is not used, and an insulation combination for a heater 200 that employs indirect heating is formed.

Figure 8:
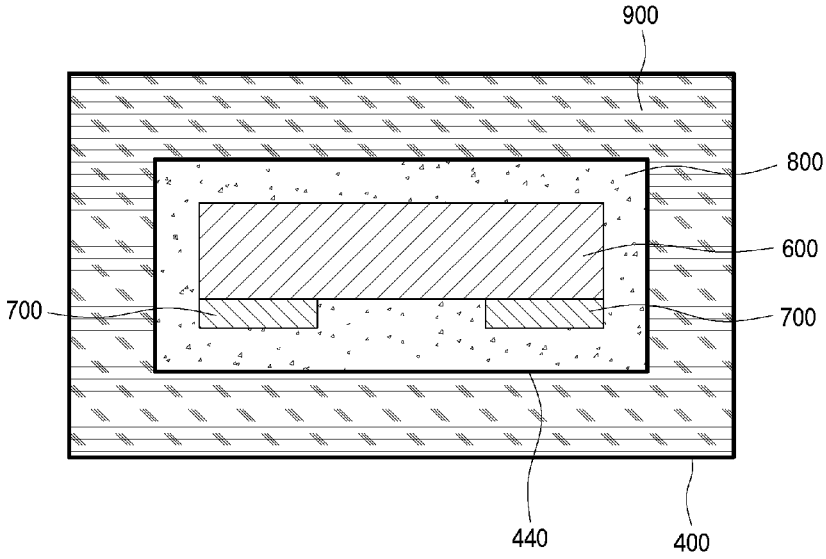

In FIG. 8, the first insulation layer and the second insulation layer form a combination of MgO 900 and a slurry-phase insulator 800.

Specifically, the heat source formed of the radiator 600 and conductive plate 700 is received within a tube 440, and the first insulation layer is formed by filling a slurry-phase insulator 800 between the tube 440 and the radiator 600 and then drying the insulator.

Also, after the MgO 900 is charged in the inner space between the tube 440 and the case 400 within a case 420 receiving the tube 440, it is compressed to form the second insulation layer.

Figure 9:
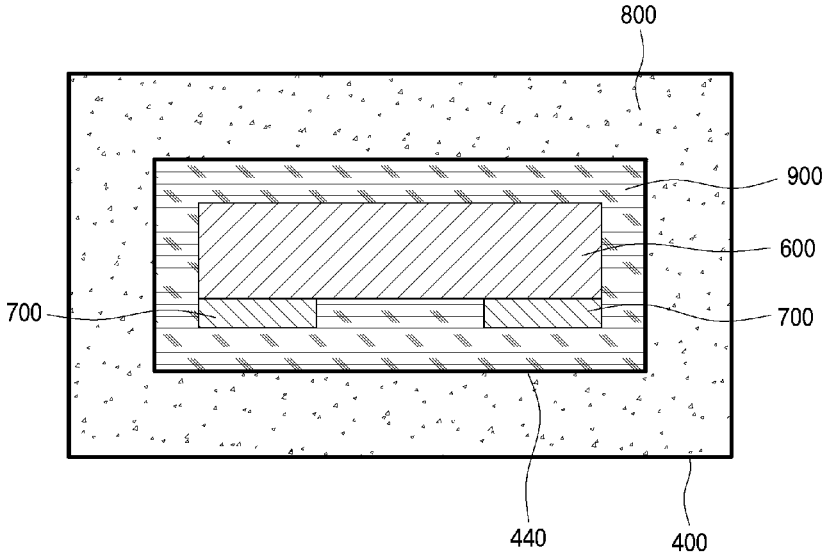

As opposed to FIG. 8, in FIG. 9, the first insulation layer is formed of MgO 900, and the second insulation layer is formed of a slurry-phase insulator 800.

That is, after MgO 900 is charged between the radiator 600 and the tube 440 that receives the latter, it is compressed to form the first insulation layer, and after the slurry-phase insulator 800 is filled between the tube 440 and the case 400 receiving the tube 440, it is dried to form the second insulation layer.

In addition, in the case of a heater 200 provided within a steam generating device 100 according to the present invention, when an insulation layer of another material is not formed on the outside of the first insulation layer, and the first insulation layer is formed with an insulation sheet 500, two layers of insulation sheets 500 may be used to form a second insulation layer and a third insulation layer outside the first insulation layer.

Figure 10:
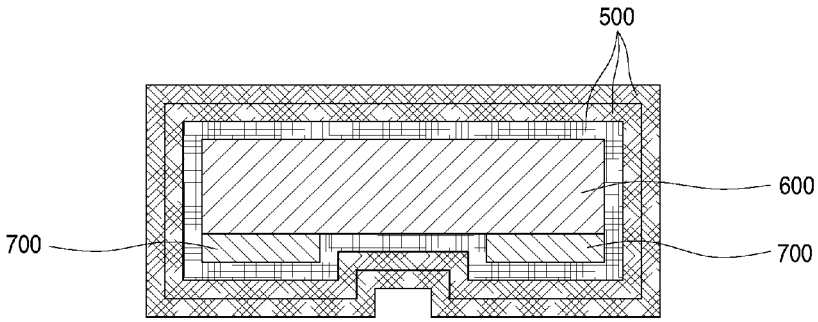

Specifically, as shown in FIG. 10, a first insulation layer is formed through wrapping a heat source formed of the radiator 600 and the conductive plate 700 with an insulation sheet 500, and a second insulation layer is formed by wrapping another layer around the outside of the insulation sheet 500 of the first layer, as described above.

Then, for the sake of added insulation, yet another insulation sheet 500 is wrapped once more around the outside of the two layers of insulation sheets 500 to form the third insulation layer, thereby forming an insulation layer consisting of 3 layers of insulation sheets 500.

Of course, if the insulation layer is formed only of the insulation sheets 500 as described above, an aluminum case 400 may be further provided outside the insulation sheets, according to the heating method of the heater 200.

Effects according to embodiments of the present invention will be described below.

To insulate a heater 200 provided inside a steam cleaner 100 according to embodiments of the present invention, a first insulation layer is formed on a radiator 600 formed of a PTC ceramic device, using any one of MgO 900, a slurry-phase insulator 800, and an insulation sheet 500.

Also, when MgO 900 or a slurry-phase insulator 800 is used to form the first insulation layer, in order to harden MgO 900 in powder form or a slurry-phase insulator 800 to be enclosed around a radiator 600, the MgO or insulator is charged or filled inside a separate case 400 and compressed or dried to be hardened.

Conversely, because the insulation sheet 500 is wound around the radiator 600, an insulation layer can be formed without having a separate case 400. That is, when the insulation sheet 500 forms the second insulation layer, a separate case 400 is not used in the case of indirect heating where the heater 200 does not directly contact water.

Also, when the first insulation layer is formed of an insulation sheet 500, a second insulation layer may be formed using the same insulation sheet 500 material as the first insulation layer, and in this case, the insulation sheet 500 is formed in three layers including the first insulation layer.

After the first insulation layer is formed, a process is performed of forming the second insulation layer of a material different from the material forming the first insulation layer.

Specifically, in the process of forming the second insulation layer, when the first insulation layer is formed of MgO 900, an insulation sheet 500 or a slurry-phase insulator 800 (and not an MgO 900) is used to form the second insulation layer.

Also, when the first insulation layer is formed with a slurry-phase insulator 800, the second insulation layer is formed using an insulation sheet 500 or MgO 900; and when the first insulation layer is an insulation sheet 500, the second insulation layer is formed with a slurry-phase insulator 800 or MgO 900, thereby forming a double insulation structure enclosing the radiator 600 that satisfies safety standards.

The above insulation layer configuration has good thermal conductivity.

Therefore, heat generated from the PTC ceramic device that is the radiator 600 is easily radiated to the outside of the insulation layer to improve heat radiating performance of the heater 200, and thus allow steam to be easily generated.

INDUSTRIAL APPLICABILITY

As a cleaning apparatus developed for effectively removing encrusted dirt, stains, etc. from a floor surface, the steam cleaner is suitable for countries with floor-centered lifestyles, and has already enjoyed sensational popularity in Korea. As demand for replacing carpets with wooden, marble, or other flooring materials increases in other countries, the demand for steam cleaners in those countries is also increasing.

As electrical apparatuses that use water, safety is a priority for steam cleaners, and cleaners that can ensure safety while being able to generate a large amount of steam in a shorter amount of time are needed.

Thus, the present invention forms the radiator 600, that is the main component of the heater 200, of a PTC ceramic device. Also, an insulation layer for electrically insulating the radiator 600 is formed of a combination from one or more of a slurry-phase insulator, an insulation film, and magnesium oxide, and this insulation layer has good thermal conductivity.

Accordingly, the inner thermal resistance of the radiator 600 is reduced to improve heat radiating performance of the heater 200 and more quickly and easily accomplish steam generation, so that it can be projected that consumer demands will be satisfied.

Further, by producing products that satisfy the above consumer demands, it is expected that outstanding sales performances can not only be achieved in Korea, but in other countries as well.

The invention claimed is:

1. A steam head comprising:

a body defining an exterior; and a steam generating device provided on the body to generate steam through heating water supplied through a heater, the heater comprising a radiator of a ceramic material, two conductive plates connected to the radiator to supply power to the radiator; and a plurality of insulation layers for insulating the radiator, wherein the plurality of insulation layers is formed of one of or a combination of one or more of magnesium oxide (MgO), a slurry-phase insulator, and an insulation film, wherein the plurality of insulation layers comprise a first insulation layer that surrounds the radiator and at least a portion of each conductive plate, and a second insulation layer that entirely surrounds the first insulation layer.

2. The steam head according to claim 1, wherein the radiator is a positive temperature coefficient (PTC) ceramic.

3. The steam head according to claim 1, wherein the steam generating device comprises:

a reservoir in which water is stored;

a heating portion into which water from the reservoir flows; and at least one or more of a heater provided to the heating portion to heat water that flows in.

4. The steam head according to claim 1, wherein the insulation layers comprises further comprise a third insulation layer formed through an insulation film enclosing the second insulation layer, wherein the first insulation layer is formed through an insulation film enclosing the radiator and the two conductive plates; and the second insulation layer is formed through an insulation film enclosing the first insulation layer.

5. The steam head according to claim 4, further comprising a case provided outside the third insulation layer, according to moisture contact of the third insulation layer.

6. The steam head according to claim 5, further comprising formations on a surface of the case to increase a static surface area.

7. The steam head according to claim 1, wherein the first insulation layer formed of a slurry-phase insulator in a shape enclosing the radiator and the two conductive plates; and the second insulation layer encloses the first insulation layer using an insulation film.

8. The steam head according to claim 1, wherein the first insulation layer is formed of a slurry-phase insulator in a shape enclosing the radiator and the two conductive plates; and the second insulation layer is formed of a magnesium oxide (MgO).

9. The steam head according to claim 1, wherein the first insulation layer is formed of a magnesium oxide (MgO); and the second insulation layer is formed using an insulation film.

10. The steam head according to claim 1, wherein the first insulation layer is formed of an insulation film; and the second insulation layer is formed of a slurry-phase insulator.

11. The steam head according to claim 1, wherein the first insulation layer is formed of an insulation film; and the second insulation layer is formed of a magnesium oxide (MgO).

12. The steam head according to claim 1, wherein the slurry-phase insulator is a magnesium hydroxide (Mg(OH)2) slurry.

13. The steam head according to claim 6, wherein a plurality of embossings is formed on the surface of the case.

* * * * *